United States Patent [19]

Peugeot

[11] Patent Number: 5,020,086

[45] Date of Patent: May 28, 1991

[54] MICROFOCUS X-RAY SYSTEM

[75] Inventor: Richard S. Peugeot, Stone Mountain, Ga.

[73] Assignee: Ridge, Inc.

[21] Appl. No.: 316,235

[22] Filed: Feb. 24, 1989

Related U.S. Application Data

[63] Continuation of Ser. No. 924,697, Oct. 29, 1986, which is a continuation of Ser. No. 593,125, Mar. 26, 1984, Pat. No. 4,688,241, which is a continuation-in-part of Ser. No. 510,660, Jul. 5, 1983, Pat. No. 4,521,902.

[51] Int. Cl.[5] ..... H05G 1/52

[52] U.S. Cl. ..... 378/113; 378/41; 378/137; 378/138

[58] Field of Search ..... 378/138, 137, 113, 99, 378/41–43; 358/111

*Primary Examiner*—Craig E. Church

*Attorney, Agent, or Firm*—Brown, Martin, Haller & McClain

[57] ABSTRACT

A microfocus type X-ray system in which the electron beam current is generally operated in a milliampere range at a constant power, and the beam is subjected to electronic focusing for selected beam width and steering for directional control.

16 Claims, 6 Drawing Sheets

FIG. 2

MICROFOCUS X-RAY SYSTEM

This application is a continuation of application Ser. No. 06/924,697, filed October 29, 1986, entitled "Microfocus X-Ray System," which is a continuation of application Ser. No. 06/593,125, filed Mar. 26, 1984, now U.S. Pat. No. 4,688,241, which is a continuation-in-part of application Ser. No. 06/510,660, filed July 5, 1983, now U.S. Pat. No. 4,521,902.

FIELD OF THE INVENTION

This invention relates generally to real time microfocus X-ray systems and the employment of such systems for stereofluoroscopy or real time tomosynthesis.

BACKGROUND OF THE INVENTION

X-ray equipment may be considered as being of the general category or of the microfocus category. In the general category, the electron beam bombarding the X-ray emitting target is not subjected to substantial focusing, and the resulting X-ray beam spot size is on the order of 0.2 mm to 5.0 mm; whereas, in the microfocus category, the electron beam is focused in a manner to achieve a quite small X-ray spot size, on the order of 10 to 200 microns. Obviously, much greater detail or resolution of viewing is achieveable with the smaller focal spot size of the microfocus equipment as the X rays essentially emanate from a point source. Up until this time, microfocus systems which provided such detail simply did not provide sufficient X-ray output to enable real time viewing, as, for example, adequate for employment with real time image display systems as opposed to the exposure of film.

In addition to the general field of microfocus X-ray systems as dealt with by this invention, its application to real time stereofluoroscopy and tomofluoroscopy appears to be substantial. As the name implies, stereofluoroscopy provides a three-dimensional X-ray image containing depth information, while tomography provides the ability to image a single planar layer of an object. While film-type stereoradiography and tomography are well established, especially in medical radiology, real time versions of these important techniques have not been very successful. Some investigators have looked into the practicality of stereofluoroscopy employing two conventional X-ray sources. A serious limitation with this is that the X-ray sources, or tubeheads, be separated by a distance equal to approximately 10% of the tubehead-to-image receptor distance in order to produce the 6° stereo viewing angle the human viewing eye-brain combination requires. Mechanical considerations make this difficult to achieve inasmuch as X-ray tubeheads are bulky, yet they must be precisely positioned, posing both space problems and cost. Further, the two X-ray tubeheads must be alternately switched on and off at TV frame rates if a TV viewing system is to be employed; otherwise, two complete imaging systems must be used, a very complicated, expensive arrangement. In any event, real time stereofluoroscopy has not become a significant reality.

Similarly, with respect to real time tomosynthesis, while film-type tomographic X-ray systems are to be found in many hospitals, little known progress has been made in the direction of achieving real time X-ray tomosynthesis. The problem here is largely because of the mechanical difficulty of achieving a close mechanical displacement of separate X-ray tubeheads and their positioning about a central pivot point lying in the plane of interest of an object.

Accordingly, and in light of the state of real time X-ray systems as described, it is an object of the present invention to provide a new and improved microfocus X-ray system and one which is suitable for and readily enables both real time stereofluoroscopy and tomosynthesis.

SUMMARY OF THE INVENTION

In accordance with the present invention, the applicant has determined a microfocus X-ray system which may be reliably operated to produce quite fine, 10–20 microns, focal spot sizes with X-ray intensity levels on the order of 100 times those previously employed. Electronic steerage of the electron beam is employed, which in turn enables an X-ray beam to emanate in sequence from different points of origin in the X-ray tube, actually at spaced points on an X-ray target, whereby X-ray beams may be projected from the tube from spaced points of origin and thereby the object illuminated by separated beams, which in turn enable different and spaced perspectives of viewing. In contrast to the generation of the different perspective views by separate X-ray tubeheads, it is possible with the applicant's system to create, simply and inexpensively, beams separated by a distance enabling the multiple beam illumination of an object compatible with desired image separation required for the eye-brain reconstruction of the desired stereo or tomo views. Thus, the present invention contemplates a most versatile microfocus X-ray system, and one which greatly expands the field of real time X-ray utilization.

DETAILED DESCRIPTION OF THE DRAWINGS

Figures 1, 2:
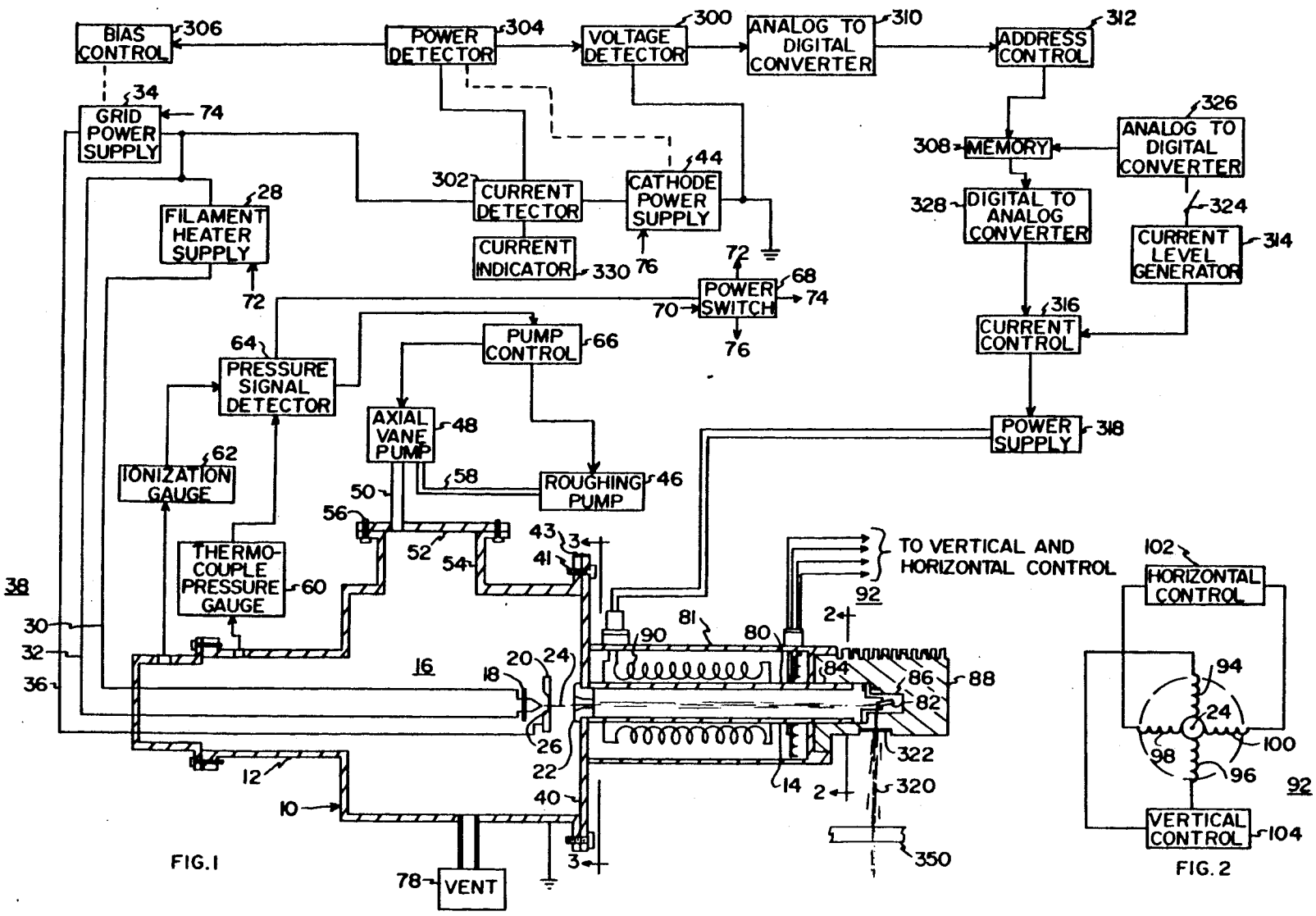
FIG. 1 is a block diagram illustrating the various components of this invention.
FIG. 2 is a diagrammatic illustration of a scanning control employed with the system shown in FIG. 1.

FIG. 1 generally illustrates an X-ray system as contemplated by this invention. It is what may be classified as a microfocus X-ray system in that it functions to emit an X-ray beam having a focal spot size in the range of 10–20 microns. It employs a high vacuum X-ray tube 10 formed of basically two separable housings or chambers, electron beam generation chamber 12 and drift tube chamber 14. A triode type electron beam gun assembly 16 is positioned within chamber 12 and employs a filament-cathode 18, a control grid 20, and a first anode 22. Filament-cathode 18 and grid 20 are of a construction particularly illustrated in FIGS. 4–6 and are electrically connected such that grid 20 is conventionally negatively biased with respect to filament-cathode 18 (FIG. 1). Electron beam 24 passes through an annular opening 26 in grid 20 and is electrostatically focused into a narrow electron beam by grid 20. Heater power for filament-cathode 18 is supplied from filament heater supply 28 through leads 30 and 32 to tube 10. The biasing potential for grid 20 is provided by grid power supply 34 wherein the positive terminal is connected to filament-cathode lead 32, and the negative terminal is connected to grid 20 through lead 36. Typically, the three leads 30, 32, and 36 would be combined in a single insulated cable 38.

Electron beam 24 is drawn under the influence of first anode 22, which is removably mounted on plate 40 between chambers 12 and 14. Plate 40 is secured to chamber 12 by bolts 41 (FIG. 3) spaced along the circumference of plate 40 and by hinge 43 which permits plate 40 to pivot. Anode 22 is annular in shape, having a central opening 42 (FIG. 3), and it is conventionally biased positive with respect to filament-cathode 18 by cathode power supply 44. This is accomplished by placing chamber 12 (and thus anode 22 and chamber 14) at ground potential and applying a negative potential to filament-cathode 18 with respect to the ground reference.

The vacuum present within vacuum tube 10 when it is operating is approximately $10^{-5}$ Torr. Rough vacuum pressure is obtained by coarse or rough pressure pump 46, and a fine vacuum pressure is obtained by an axial vane pump 48. Pump 48 is directly coupled via pipe 50 to a flange plate 52 which covers an access opening 54 in tube 10 and is sealably (by seals not shown) bolted in place by bolts 56. Roughing pump 46 is conventionally coupled by a pipe 58 through vane axial pump 48 to the interior of tube 10. Roughing pump 46 is employed to initiate vacuum pumping and is operated to pump down the pressure in tube 10 from atmospheric pressure to approximately $10^{-1}$ Torr, after which axial vane pump 48 is operated to increase this vacuum to an operating pressure of approximately $10^{-5}$ Torr. The pressure level within chambers 12 and 14 is monitored by thermocouple pressure gauge 60 and Penning or ionization gauge 62. Thermocouple pressure gauge 60 measures lower vacuum levels, and ionization gauge 62 measures higher vacuum levels. Both gauges 60 and 62 are of conventional construction and in their usage here provide electrical outputs representative of their measurements to pressure signal detector 64. Detector 64 is a commercially available device which combines the signal outputs of the two-range gauges and provides appropriate turn-on signals to pump control 66 to turn on either roughing pump 46 or axial vane pump 48, as required. Additionally, detector 64 provides a control signal to power switch 68 to close switch 68 when an operating vacuum is present. Power switch 68 is connected between A.C. inlet power lead 70 and outlet power leads 72, 74, and 76 which power, respectively, filament heater supply 28, grid power supply 34, and cathode power supply 44.

Vent valve 78 enables the vacuum within tube 10 to be released, which enables the opening of tube 10 for replacement of interior components or other service.

Drift chamber 14 is formed of an elongated brass cylinder 80 through which electrons, which have been accelerated by first anode 22, travel at nearly the speed of light until they impinge upon metal target 82, e.g., tungsten or tungsten alloy. Target 82 is removably secured in end region 84 of brass cylinder 80 to a metal holder (as by a friction or interference fit) and heat sink 86 which is bolted to an end plate 88 generally forming a second anode. Second anode 88 slips over the end of brass cylinder 80 and is sealably attached to cylinder 80 by an O-ring and screws not shown.

Figure 8:
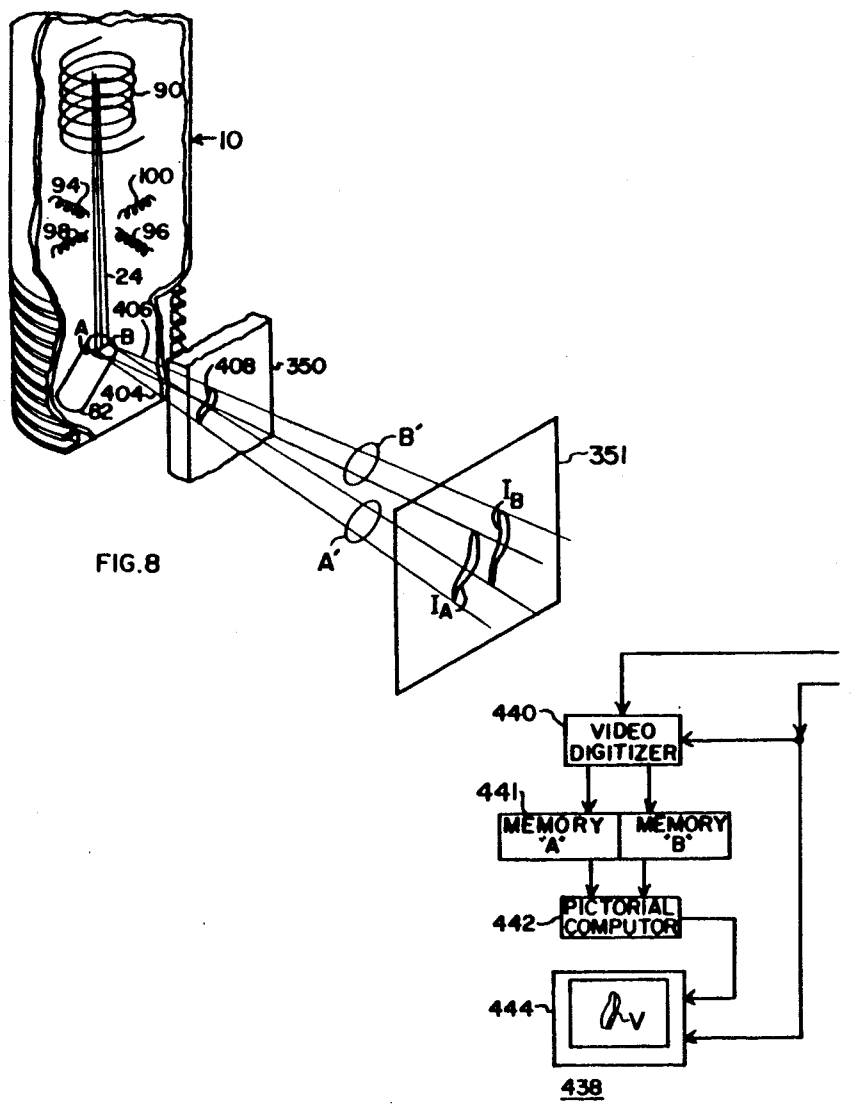
FIG. 8 is a perspective view of a dual beam imaging system.

A focusing coil 90 positioned within a removable coil housing 81 is wound around cylinder 80, and it creates a focusing electromagnetic field through which the electrons drift or travel. This field concentrates or converges the electrons into a narrower electron beam, being adjusted to be on the order of 10 to 20 microns when it strikes a planar end of target 82 as shown in FIG. 8. A beam deflection assembly 92 (FIG. 2) is arranged within coil housing 81 between focusing coil 90 and target 82, and it consists, diagrammatically, of a pair of vertical effect deflection coils 94 and 96 and a pair of horizontal effect deflection coils 98 and 100, a conventional arrangement. Horizontal effect deflection coils 98 and 100 are powered and controlled by a conventional horizontal control 102 (FIG. 2) which applies a selected differential signal to the horizontal coils such as a square wave, to effect a side-to-side deflection of beam 24 and thereby the lateral position of the focal spot on target 82 when it is struck by beam 24. Vertical effect deflection coils 94 and 96 are powered and controlled by a conventional vertical control 104 (FIG. 2) which applies a selected differential signal to the vertical coils to such as a square wave, effect control of the vertical positioning of the focal spot on target 82. By virtue of this control arrangement, the point of impingement of beam 24 on target 82 may conveniently be periodically moved, and thus the whole surface of the target may be adjustably impinged upon to enable even wearing away of the target and thus its full utilization. This, of course, enables a longer effective target life. In addition to electromagnetic focusing and deflection of the electron beam, in some instances it may be appropriate to employ electrostatic means. In addition to the two point deflection pattern illustrated, the electron beam may also be electronically swept or moved in a stepwise or continuous fashion to effect multiple focal spot locations or a focal spot locus as may be required for tomography or stereo-imaging. Target life is further extended by the employment of a doped powdered metallurgy tungsten target (as opposed to vacuum melted tungsten) and by adding to the composition of the tungsten a small percentage, approximately 2%, of thorium.

Figures 3, 4, 5:
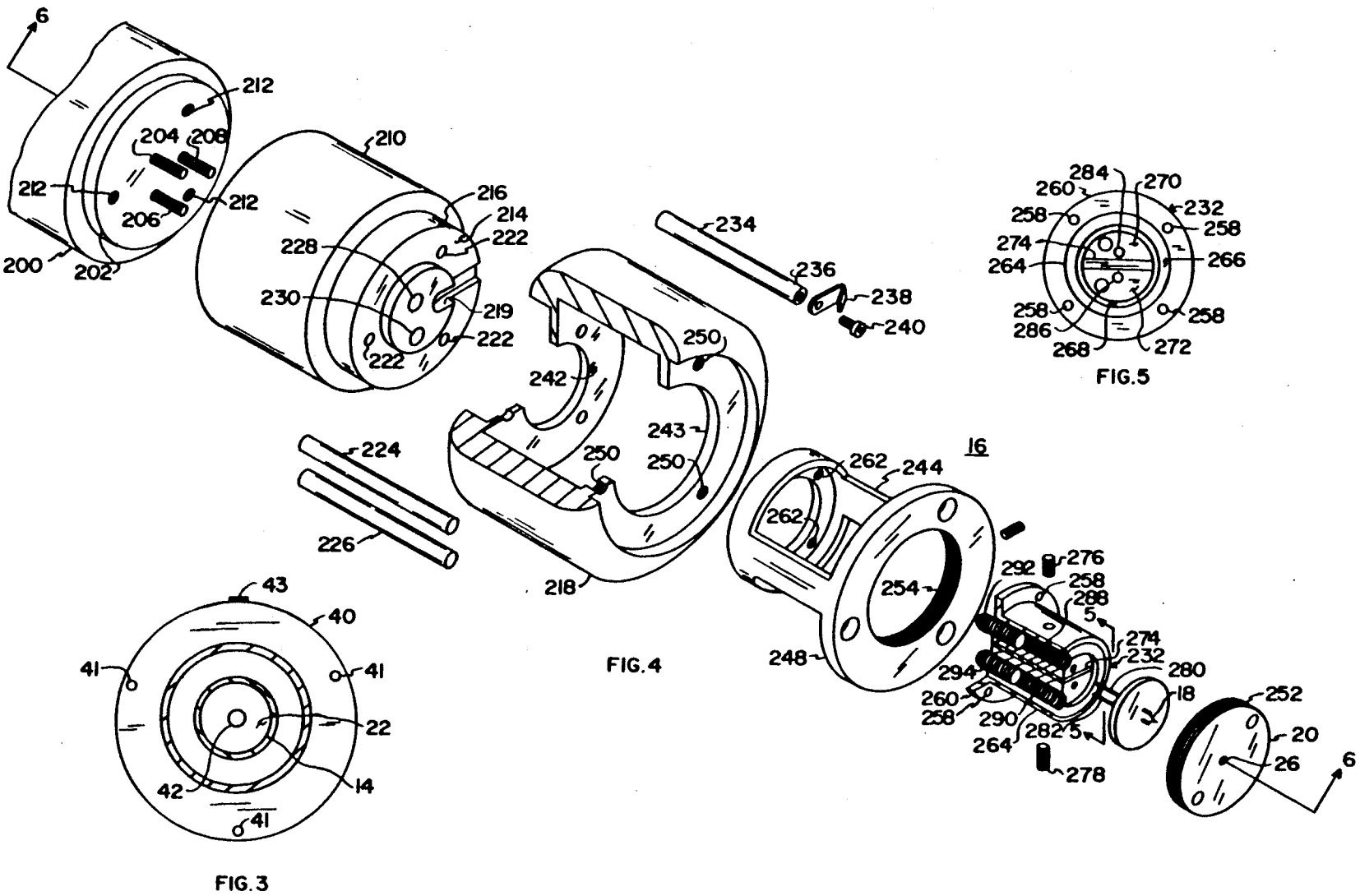
FIG. 3 is a sectional view, partially cut away, taken along line 3—3 of FIG. 1.
FIG. 4 is an exploded view of the electron gun assembly.
FIG. 5 is a sectional view, partially cut away, taken along line 5—5 of FIG. 4 of a portion of the filament socket assembly.
Figure 6:
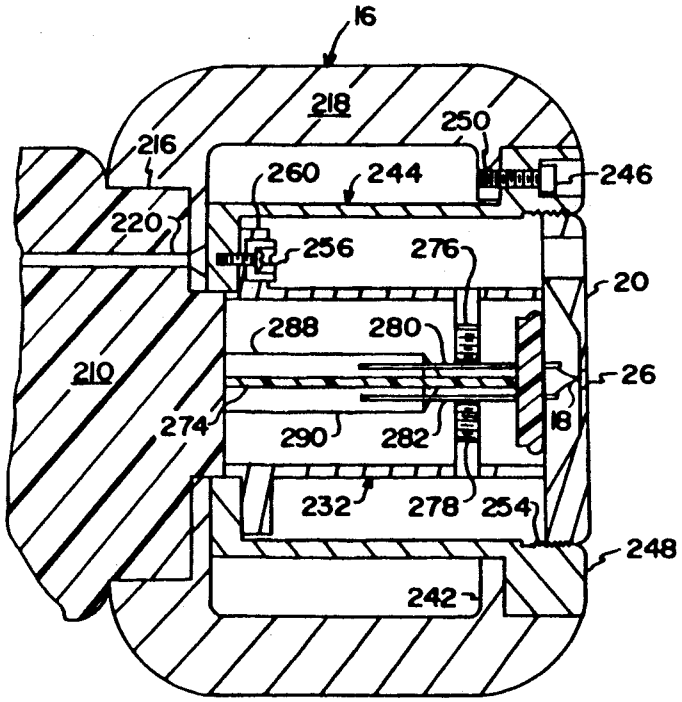
FIG. 6 is a sectional view taken along line 6—6 of FIG. 4 of the assembled electron gun assembly.

FIGS. 4–6 illustrate the unique construction of electron gun assembly 16. Electron gun assembly 16 is mounted on an insulated feed through cable connector 200 which extends through the wall of tube 10 (FIG. 1). Connector 200 is only partially shown, with the outside of the end region 202 being cylindrical, as shown. There are three threaded conductive pins extending from cable connector 200. Of these, pins 204 and 206 are filament powered pins which are connected to conductors 30 and 32 of FIG. 1. The third pin 208 is a threaded pin which supplies a grid bias potential, and it is connected to conductor 36 (FIG. 1). An insulated support 210 has an inner end diameter (not shown) on its left side which fits over cylindrical end region 202 of connector 200 and is supported thereby. Three threaded openings 212 in connector 200 (the entire connector acts as an insulator/standoff) are adapted to commonly support the several elements of electron gun assembly 16. Thus, the outer (right) end 214 of support 210 has a reduced diameter region 216 adapted to support what is termed a bias cup 218 which is supported on support 210 by bolts 220 (FIG. 6). These bolts basically secure together through openings 222, bias cup 218, insulated support 210, and cable connector 200.

Filament 18 is powered from threaded conductive pins 204 and 206 through conductive rods 224 and 226 which thread over (by threads not shown) pins 204 and 206, respectively. Conductive rods 224 and 226 extend through openings 228 and 230 in insulated support 210 and appear as contacting posts for connection to filament socket assembly 232. Third conductive rod 234 extends through support 210 and has a threaded end which threads over pin 208 of cable connector 200. The opposite end 236 of conductive rod 234 is also threaded, and a spring-type electrical contact 238 is attached by bolt 240 to it. When in place, spring contact 238 fits generally within bias cup 218 and within cutout 219 in support 210. This spring contact 238 engages flange 242 of bias cup 218 whereby bias cup 218, being metal, is generally maintained at bias potential.

Filament-grid support 244, being connected via bolts 246 (FIG. 6) to bias cup 218 and being metal, is also generally held to bias potential. Bolts 246 extending through flange 248 of filament grid support 244 and into threaded openings 250 within flange 243 of bias cup 218. Grid 20 has external threads 252 and is secured to filament-grid support 244 by screwing it into mating threads 254 in flange 248. In this fashion, the grid bias on filament-grid support 244 is supplied to grid 20.

Filament socket assembly 232 is secured by bolts 256 (FIG. 6) through its openings 258 in flange 260 to threaded openings 262 in filament-grid support 244. Thus, filament socket assembly 232 is generally positioned within filament-bias support 244, with its filament 18 being positioned just interior of flange 248 of filament-grid support 244. Filament socket assembly 232 is formed with an outer tubular member 264 of insulating material. Interior of it is a metal cylinder 266 (FIG. 5), and interior of it is insulating sheath 268. Two semi-circular conductive blocks 270 and 272, separated by insulating sheath 274, are positioned within sheath 268. They are secured in place by set screws 276 and 278. Filament terminals 280 and 282 of filament 18 frictionally fit within receptacles 284 and 286 of blocks 270 and 272. These terminals 280 and 282 are electrically connected to conductive rods 224 and 226 via a pair of threaded spring-extensible contacting members 292 and 294 within cavities 288 and 290 to effect a spring biased connection between the filament terminals 280 and 282 and rods 224 and 226.

By virtue of the construction just described, and the fact that plate 40 is removable from tube 10, repair and replacement of any of the elements of electron gun assembly 16 or target 82 is possible. As is evident from its construction, insulated support 210, which has connected to it bias cup 218, grid support 244, filament socket assembly 232, and grid 20, is separable from cable connector 200 and provides a plug-in assembly between support 210 and connector 200. Additionally, filament socket assembly 232 and grid 20 are separable from support 244, which provides for easy replacement of these components. To obtain access to these components, it is necessary to release the vacuum within tube 10 via vent valve 78 and to disassemble tube 10 by removal of bolts 41 and pivoting chamber 14 with respect to chamber 20 about hinge 43.

The operation of X-ray tube 10 is basically adjustable by the adjustment of cathode power supply 44 (FIG. 1), which would typically be manually (directly or by remote control) accomplished with settings chosen as a function of the particular object to be X-rayed. The magnitude of the voltage provided by power supply 44 is detected by voltage detector 300 and the current by current detector 302 in series with the output of power supply 44. The outputs of voltage detector 300 and current detector 302 are provided to power detector 304 which provides, as an output, a signal representative of the product of current and voltage and thus the power of the electron beam circuit. This power output signal is provided to control grid bias control 306 which controls grid power supply 74 to control the bias voltage as a direct function of power applied to the beam. In this manner, the actual power in the electron beam may be held constant at a selected value. As a feature of this invention, it is held in the range of from 0 to 800 watts, a 100 times increase in power levels for microfocus systems of similar focal spot sizes.

As another feature of this invention, coordinated with changes in cathode voltage, focusing coil 90 is controlled to optimumly vary the power (as by current controlled field strength) input to focusing coil 90 as required to maintain a minimum beam diameter of the beam when it impinged on target 82. As an example of a means of accomplishing this, the signal values for the focusing coil current, or voltage input levels, occurring with respect to the anode voltage levels, are stored in a memory 308. Coordinate signals representative of discrete synchronized cathode voltage levels are fed from voltage detector 300 to analog-to-digital converter 310, which then digitizes these signals and supplies them to a conventional address control 312 which employs them to determine discrete address memory locations in memory 308. Initially, with a selected discrete cathode voltage level (typically a peak or minimum value) and a coordinate address in memory 308 enabled, current level generator 314 would be adjusted to operate current control 316 to control power supply 318. This power supply then provides to focusing coil 90 an electrical input level which produces a minimum electron beam spot size (at target 82) which is determined by observing the resultant X-ray beam 320 emanating from target 82 through demountable window 322. When this level is determined, switch 324 is operated closed to enable analog-to-digital converter 326 to sample the current (or voltage) level present and supply a representative signal of this level to the address of memory 308 just enabled as described. This process would be repeated through the range of operation of anode-cathode voltages, and memory 308 would be programmed with a complete set of cathode voltage-focusing current signal coordinates. Thereafter, the system would operate automatically, and thus with a selected cathode voltage, analog-to-digital converter 310 would, via address control 312, provide an address signal for a discrete cathode voltage level to memory 308, which would then supply to digital-to-analog converter 328 an appropriate coordinate current (or voltage) level signal which would then be supplied to current (or voltage) control 316 which would cause power supply 318 to power focusing coil 90 with an optimum level of input.

By virtue of the combination of automatic power control and automatic focusing control, there is provided a system which enables simple but precise control of the X-ray beam and wherein the only operator control needed is the selection of anode voltage. With this accomplished, the system is operated at the most effective mode of operation. Manual control of focal spot size is also provided because at times it may be desirable to defocus slightly in the interest of longer X-ray target life or if too much detail is shown in the X-ray image. This is accomplished by reference to beam current, visually indicated by milliampere meter current indicator 330 (FIG. 1) and disabling automatic control of power supply 318. Alternately, power supply 318 would be manually controlled, conventionally by means not shown.

Figure 7:
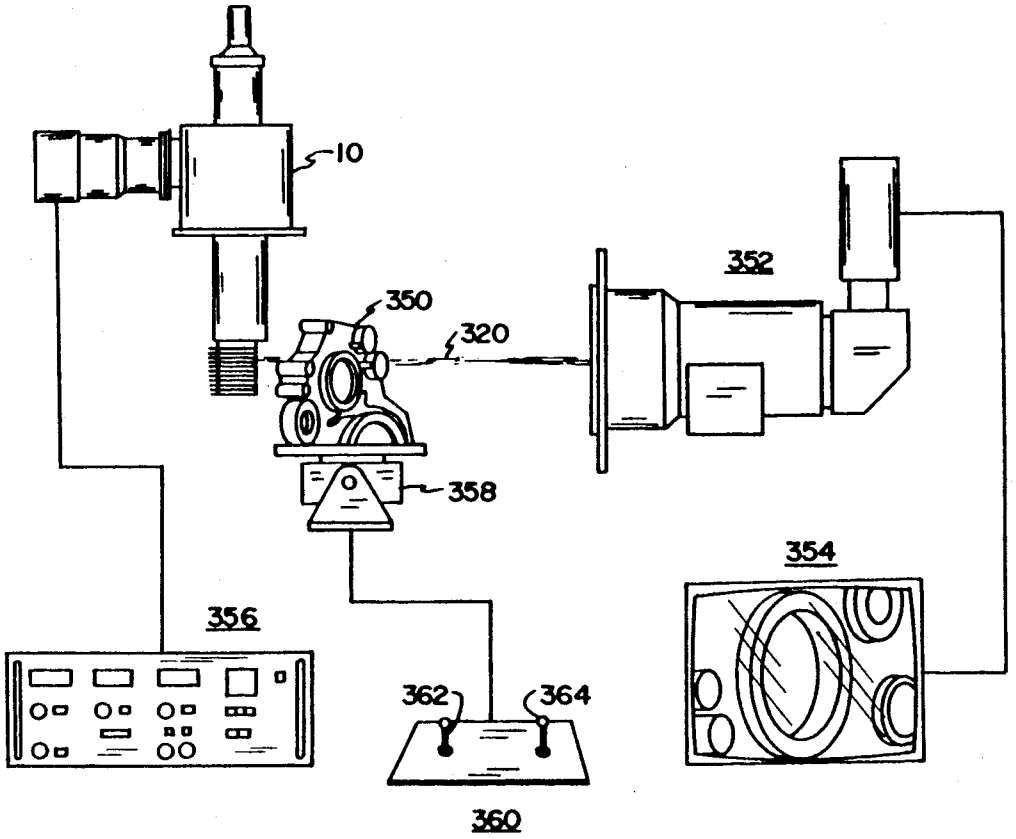
FIG. 7 illustrates the various components preferred for real time viewing using the microfocus X-ray system.

FIG. 7 generally illustrates a complete real time viewing X-ray system. As shown, a test object 350 is placed in the path of X-ray beam 320 between tube 10 and an image intensifier 352. Image intensifier 352 is conventional and converts an X-ray pattern of the object into television signals, which are then fed to a conventional television monitor 354 upon which the pattern of the portions of the object being X-rayed are displayed, as shown. The control system, indicated with the numeral 356, is illustrative of the circuitry portion of FIG. 1 and generally enables control of tube 10 as described. Object 350 is shown mounted on a conventional manipulating table 358, and it is conventionally controlled by control 360, having appropriate operating controls, illustrated by control knobs 362 and 364 whereby the position of object 350 may be generally varied.

To review operation, first, of course, tube 10 would have been evacuated by operation of pumps 46 and 48 as described. Of course, during this procedure, vent valve 78 would be closed. Next, with the operating potential supplied, the focusing potential would be calibrated by operating variable power supply 44 through a range of voltages, for example, from 10 KV D.C. to 160 KV D.C. At selected incremental points, focusing current levels for these voltages would be stored in memory 308 as previously described. This having been done, an object, such as shown in FIG. 7, would be placed on table 358 for X-raying, and an operator would select a voltage output for power supply 44 which would produce a selected X-ray output. This would depend somewhat on the degree of magnification which is to be employed with respect to the viewing of object 350. Magnification is varied by varying the relative postion of object 350 between X-rays tube 10 and image intensifier 352. Thus, in order to increase magnification, the object is moved toward the source of X-ray beam and away from the image intensifier. By virtue of the present system which provides an extremely small focal spot size at significantly high power levels, the magnification effect may be significantly improved. Thus, whereas in the past where the spot size was relatively large for real time viewing, when one attempted to effect significant magnification, the resolution of X-ray examination readily deteriorated. The real cause is the penumbra or the area of partial illumination or shadow on all sides of full radiation intensity. Since X rays are emitted statistically from any point within the focal spot, crisscrossing of these rays occur, especially with larger focal spots. A microfocus source is nearly a point source where the X rays all seem to come from a single focal point with little or no penumbra. This small focal spot decreases fuzziness and increases detail. As an example of the difference, previously with X-ray systems employable for real time viewing, the limits of magnification were on the order of two to three times. On the other hand, with the present system employing an approximate 10 micron beam, geometric magnifications of up to 100 or more times may be achieved with acceptable detail. Not only does this technique produce significantly sharper film radiographs, but it in a large measure overcomes the limited resolution of real time imaging systems by presenting to the imaging system an already enlarged image having greatly improved detail.

Another significant benefit provided by the present system is that of increased X-ray image contrast, this being related to geometric enlargement and occurs because the image intensifier receives less scattered radiation when the test object is moved away from the image receptor. This is because the intensity of an X-ray beam falls off as the square of the distance, and thus scattered radiation has less effect. Further, by virtue of the automatic focus control, an operator need not repeatedly adjust focus voltages in order to obtain an optimum beam size.

In addition to the improvement in quality of performance, other operating advantages are achieved. Thus, by virtue of the demountability of the tungsten target, it may be operated quite close to the melting point of the tungsten target, a risk which would not be prudent with a sealed tube design. Second, by virtue of the fact that the high level electron beam is steerable, it may be readily moved over the area of the target when a burn occurs or kept in continuous motion for stereo or tomographic techniques.

Further, the target is particularly constructed, being made of sintered tungsten with a thorium additive, and as such, it provides improved target life as compared with conventionally melted tungsten. Beyond this, by virtue of the demountability of the tube, a new target may be installed. Similarly, new or different shaped anodes (e.g., having an annular opening) may be installed. Further, not only may a new filament be readily replaced, but by virtue of the plug-in filament and bias cup arrangement, the filament and grid elements may be precisely aligned before being installed. This prealignment procedure enables both fast and accurate filament and/or grid replacement.

Figure 9:
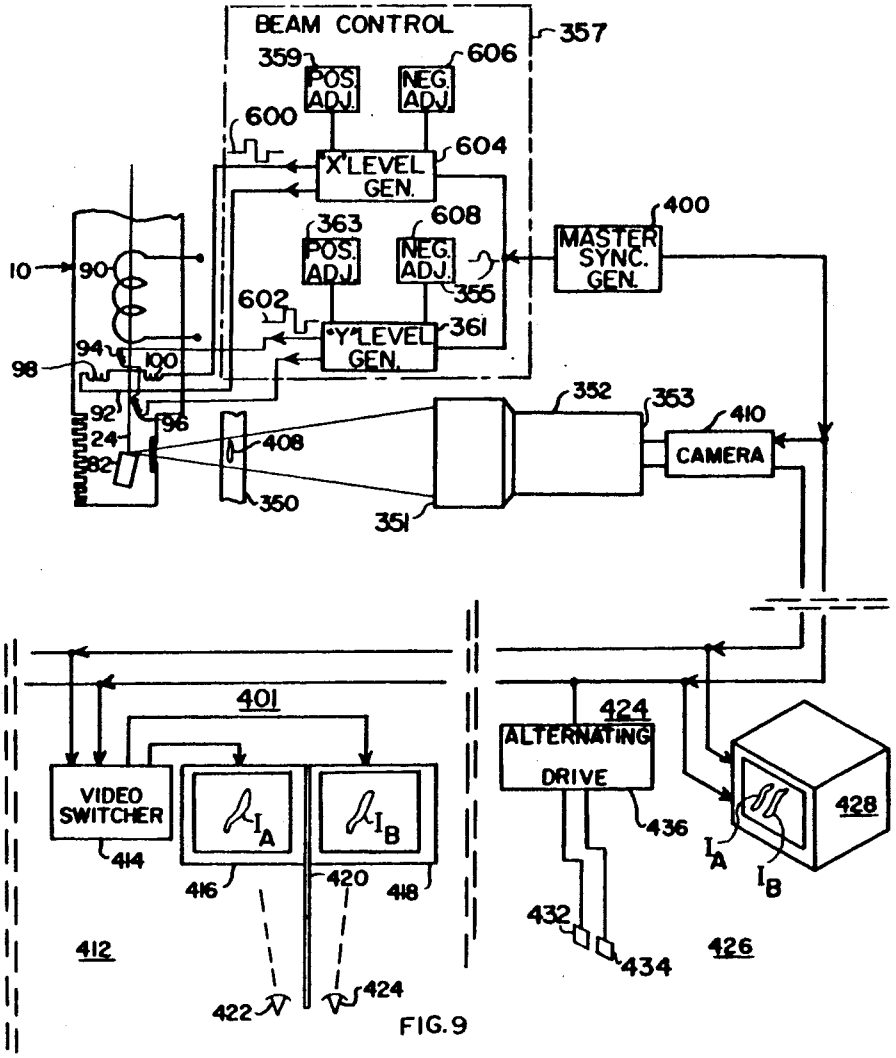
FIG. 9 is a diagrammatic view of a three-dimensional X-ray viewing system, in general, employable for both stereofluoroscopy and tomosynthesis.

FIGS. 8 and 9 particularly illustrate a stereo or multidimensional microfocus real time imaging system as contemplated by this invention.

FIG. 8 generally illustrates the arrangement of the system wherein microfocus tube 10 provides an X-ray beam which is directed through a flaw 408 in an object 350 to be examined. Thereafter, the X-ray image of this object is directed onto the responsive face 351 of a X ray-to-visible light converter, represented by a conventional image intensifier 352 (FIG. 9). The visible light on face 353 of image intensifier 352 viewed by a television camera 410 (FIG. 9). As illustrated in FIG. 8, electron beam 24 is selectively deflected by a conventional quadrature electron beam deflection assembly employing deflection coils 94, 96, 98, and 100. By this arrangement, electron beam 24 is caused to, in one instance, strike target 82 at selected point A; and in another instance, is caused to strike target 82 at a second selected point, point B. Thus, a beam emanates from spaced points of origin A and B, the beam origin being alternated in synchronization with the field rate of camera 410 to provide sequentially alternating, spaced, perspective views. Thus, object 350 is struck by one beam A' which passes through object 350 to create a first X-ray image $I_A$ of flaw 408 of object 350 on face 351 of image intensifier 352 (FIG. 9) at a first location. Thereafter, and alternately, object 350 is struck by a second X-ray beam B' emanating from point B on target 82, and as a result, there appears during the duration of this beam image $I_B$ on image intensifier 352. The sequential images are reproduced in visible light on the output face 353 of image intensifier 352 and viewed by camera 410, synchronized for sequential viewing by an input from sync generator 400. Alternately, any program pattern of impingement of electron beam 24 on target 82 may be effected, and, accordingly, a pattern of points of X-ray emission from target 82 may be effected by appropriate drive of the deflection coils.

FIG. 9 particularly illustrates three versions of television-type, and synchronized, reproductions of the sequential outputs of TV camera 410. Synchronization between television-type reproduction, which is typically at 60 fields per second (30 frames), is effected by switching the X-ray beam paths in accordance with the field rate of pulse 355 of master TV sync generator 400 which controls the television camera and display or displays employed. This sync signal is fed to X beam signal level generator 356 of beam control 357 which, responsive to the sync signal, develops a bi-level rapidly changing or stepped, output signal 358 switching between preset levels as shown with the occurrence of each sync pulse which determines the X coordinate of points A and B on target 82. The first half cycle position of signal 358 may be represented as determining the X coordinate of point A and the second half cycle as representative of the X coordinate of point B. The specific X coordinates are adjustable, the level of the first half cycle being adjustable by positive adjustment 359, and the second half level by negative adjustment 360. Thus, the positive adjustment, as shown, may be deemed to control the X coordinate of point A, and the negative adjustment to control the X level coordinate of point B. Similarly, the Y coordinate for the points of impingement A and B of beam 24 on target 82 are determined by Y signal level generator 361, providing as a rapidly changing or stepped signal 362 the first half cycle level controlled by positive adjustment 363 and second half cycle level controlled by negative adjustment 364. Thus, the first half level cycle may be deemed to control the Y coordinate of point A and the second half cycle to control the Y coordinate of point B. As in the case of X level generator 356, the switching between levels is accomplished by trigger pulse 355 from master sync generator 400.

The outputs of X level generator 356 and Y level generator 361 are fed to the quadrature deflection coils of tube 10, as illustrated by coil sets 94 and 96 and 98 and 100, as shown.

With the arrangement described, beam 24 dwells on position A of target 82 for essentially 1/60 second, then X-ray beam 24 is switched rapidly, in approximately one microsecond, to a second position, position B on target 82 for essentially 1/60 second, which, in both instances, is the resultant of the outputs of X level generator 356 and Y level generator 361. Thus, there has occurred a significant dwell time for each of the resulting X-ray beams A' and B', from target positions A and B, respectively, with an extremely rapid switching between them and which is therefore essentially imperceptible.

The points of impingement A and B on target 82 is chosen such that both beams A' and B' pass through flaw 408 in object 350, and thus there is effected the dual X-ray images of flaws designated $I_A$ and $I_B$, illustrated as being projected onto the face 351 of image intensifier 352. In order to perceive depth, or a three-dimensional effect, from this dual path exposure of flaw 408, three systems are illustrated in FIG. 9. In each, television camera 410 views the output of image intensifier 352 and converts alternately appearing visible light versions of images $I_A$ and $I_B$ into standard electrical television-type signals wherein these images are sequentially provided as outputs.

In the first system, system 401, two television monitors 416 and 418 are alternately and sequentially operated on to enable the reproduced image $I_A$ to be viewed by TV monitor 416 and B' to be viewed on TV monitor 418. Monitors 416 and 418 are alternately switched on by video switcher 414 in response to a signal from sync generator 400. These monitors are separated by a partition 420 such that, for example, the viewer's left eye 422 is only able to view monitor 416, and the viewer's right eye 424 is only able to view monitor 418. Thus, each eye views a separate image, either $I_A$ or $I_B$, on separate monitors which enables a viewer to perceive a stereo or three-dimensional view of flaw 408 in object 350.

System 424 employs only a single monitor, it being operated to reproduce images $I_A$ and $I_B$ sequentially, responsive to the image output of camera 410 and sync generator 400. In order to create three-dimensional perception, a special viewing system is employed which includes electrically operated optical or window units 432 and 434 which are positioned to control viewing by the individual eyes of a viewer. Each of these comprises a piezo-electric or other electro-optical unit which, responsive to an electrical signal, rotates the polarization or admissibility of light to effect the visibility or the blocking of visibility. They are alternately, and sequentially, powered by electrical drive 436, triggered by a signal from TV master sync generator 400. Synchronization is such that when $I_A$ is displayed on monitor 428, left-hand window unit 432 is open and right-hand window unit 434 is closed, or light blocked. Similarly, when image $I_B$ is displayed on monitor 428, left-hand unit 432 is closed and right-hand unit 434 is open. Thus, with this arrangement, each eye only views one of images $I_A$ and $I_B$; and as each of these views is from a slightly different perspective as described above, the viewer is able to discern depth of view of flaw 408. Instead of sequential viewing to effect differentiation between images, a conventional two-colored viewing of two images on the same screen may be employed.

System 438 is one in which elements of the two image outputs, A' and B', are digitized by a conventional video digitizer 440, responsive to the output of camera 410 and sync generator 400, and the separately digitized images are stored, respectively, in memory A and in memory B of digital memory 441. The stored images, which are derived from two perspectives, are combined by pictorial computer 442 which is a computer programmed by a conventional stereo reconstruction algorithm to create analog signals representative of a pictorial or three-dimensional type presentation, which is then fed to a TV monitor 444 which displays it in a conventional fashion. The displayed image V would essentially be what a viewer would see by viewing with one of the other systems described.

Figure 10:
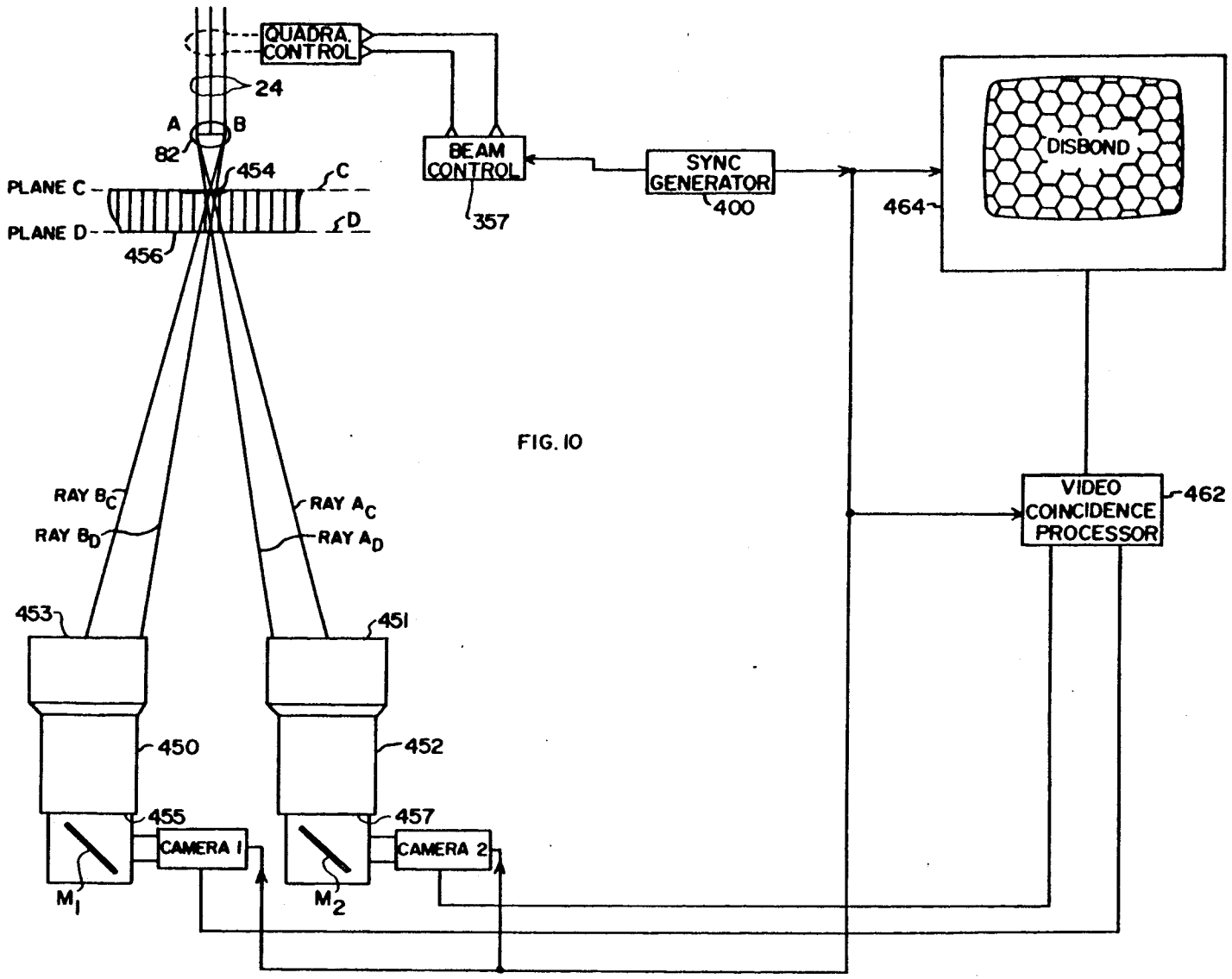
FIG. 10 is a diagrammatic illustration of a microfocus system employed to effect real time tomofluoroscopy.

FIG. 10 illustrates one system employing X-ray tube 10 for tomofluoroscopy, a system wherein enhanced viewing of a discrete region of a discrete plane of a material is achieved. The system is essentially identical to that shown in FIGS. 8 and 9 to the extent of the electrical control system represented by sync generator 400 and beam control 357, and it operates similarly to the extent that it sequentially generates beams having origins A and B on target 82. The system employs two X ray-to-visible light converters, image intensifiers 450 and 452, and these being particularly spaced as will be described. In the example shown, it is desired to particularly view a flaw 454 in plane C of object 456 and de-emphasize or blur all other detail of object 456 appearing in other planes of the object. As in the case of the system shown in FIG. 9, the electron beam 24 is scanned between selected target positions A and B, and as a result, two separated X-ray beams are generated and which emanate from spaced points A and B on target 82. The two image intensifiers 450 and 452 are spaced such that a ray $A_C$ (from point A on target 82) passes through flaw 454 in plane C of object 456 and strikes the center of the input face 451 of image intensifier tube 452, and ray $B_C$ (from target point B), sequentially following ray $A_C$, also passes through flaw 454 and strikes a center position on the face 453 of image intensifier 450.

As is illustrated by rays $A_D$ and rays $B_D$ which are shown to intersect and thus image a portion of object 456 in plane D, it is to be noted that these X-rays necessarily strike unlike or opposite side regions of the input faces of image intensifiers 450 and 452. Thus, while images $A_C$ and $B_C$ are seen in like register by the two image intensifiers, rays $A_D$ and $B_D$ are not. Accordingly, while the visible light replicas of flaw 454 as converted from rays $A_C$ and $B_C$ will appear as like positioned objects on the output faces 455 and 457 of image intensifier tubes 450 and 452, other images such as those transmitted by rays $A_D$ and $B_D$ will appear in different regions of the visible light images appearing on the output faces 455 and 457 of image intensifiers 450 and 452.

The visible image outputs of image intensifiers 450 and 452 are separately viewed, through mirrors $M_1$ and $M_2$, by TV cameras No. 1 and 2, camera No. 1 being synchronized by an output from sync generator 400 to be turned on to view during the existence of X-rays emanating from target B (e.g., rays $B_C$ and $B_D$), and camera No. 2 is turned on by a sync output of sync generator 400 to view only X-rays from target A (e.g., rays $A_C$ and $A_D$). The pictures or TV frames showing the outputs of image intensifiers 450 and 452 are provided in the form of conventional TV signals to video coincidence processor 462 which is a conventional device which simply adds like positioned pixels from the two camera TV outputs, it, too, being synchronously driven by an output from sync generator 400. The summation of the two, in effect, overlayed pictures presented at the outputs of image intensifiers 450 and 452, is fed as a single TV frame or picture to an input of a conventional TV monitor 464, it, too, being synchronized in operation by a sync signal from sync generator 400.

Keeping in mind that it is the goal of this system to provide a distinct image of flaw 454 in plane C of object 456 and to create essentially a blurred background with respect to any other detail, it is to be appreciated that this has been accomplished by virtue of the fact that TV cameras 1 and 2 register only a like image of flaw 454 in plane C and otherwise they view unlike pictorial information which then, when added together, provides a fuzzy, indistinct or other blurred background for the distinct image. In this manner, a viewer of TV monitor 464 would see only distinctively the central flawed portion of plane C, labeled DISBOND on the face of TV monitor 464.

Figure 11:
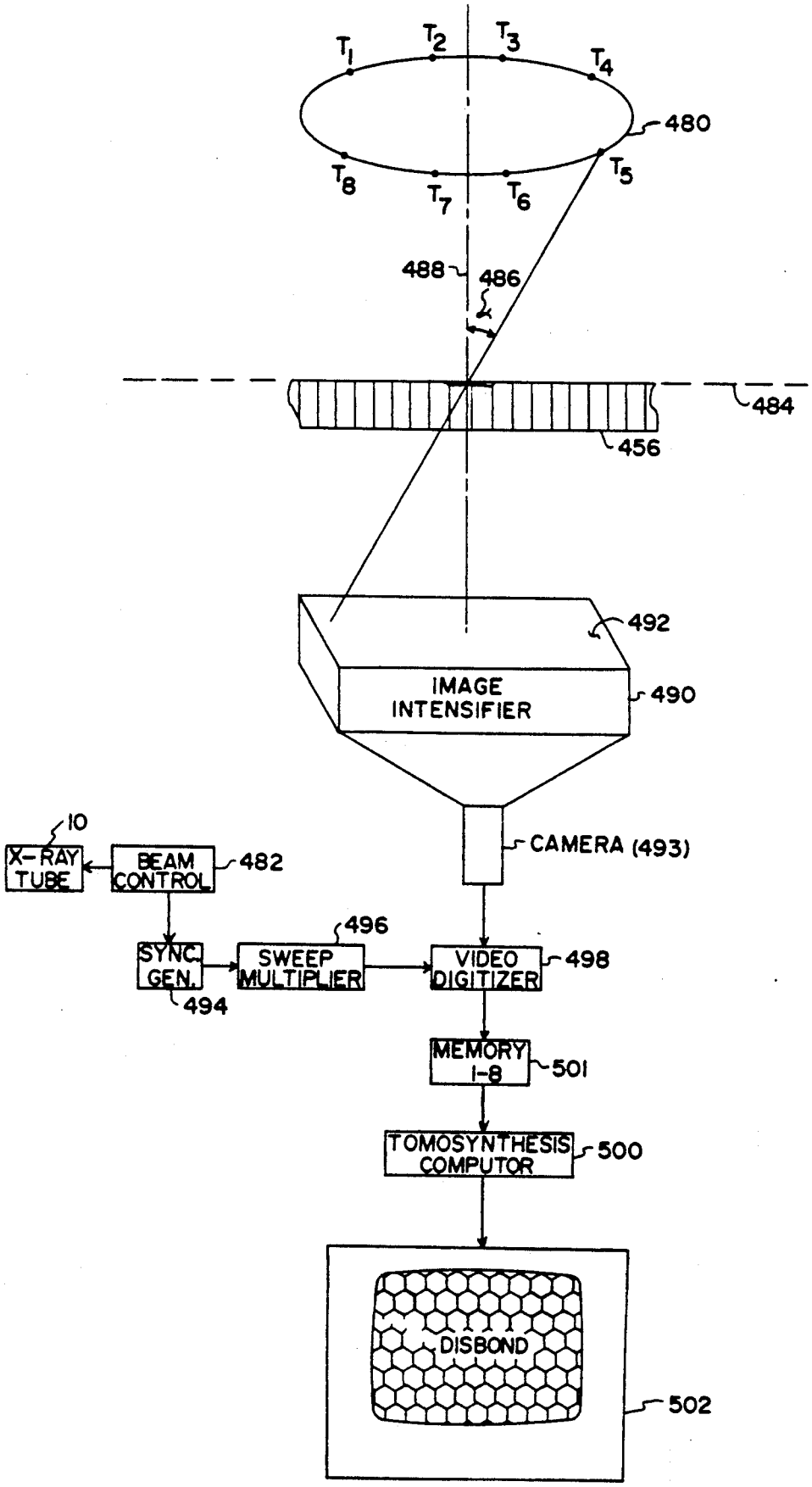
FIG. 11 is a diagrammatic illustration of a modification of the system shown in FIGS. 8, 9, and 10 adapted to effect tomosynthesis employing a single viewing device, and wherein perspective views are in terms of points on a circular pattern of X-ray beams.

A second and improved system for tomosynthesis is shown in FIG. 11. In this system, the object 456 is scanned by an X-ray beam from a circular position on target 82, resulting from electron beam 24 being scanned in a circle 480 by appropriate control signals from beam control 482 and applied to the deflection coils of microfocus X-ray tube 10. In this manner, and as shown in FIG. 11, a point in the center of the plane 484 of interest of object 456 is scanned by the circular X-ray beam creating an annular region of X-ray emanation as depicted by the width of the circular line of circle 480. This point maintains the same angle 486 with respect to the axis 488 of viewing.

This mode of scanning has previously been determined to be effective in tomosynthesis accomplished by the in-register combination of a series of X-ray photographs effected by X-ray beams emanating from positioning an X-ray source at multiple points on a circle around a central axis. The circular scan approach effects a much more complete cancellation of details of slices of planes not of interest that does the system shown in FIG. 10. The system shown in FIG. 11 differs from the prior photographic approach in that instead of employing a single X-ray tube and moving it or using several X-ray tubes, the electron beam of applicant's microfocus tube is swept around in a circle. In contrast to the system shown in FIG. 10, which employs two image intensifier tubes, a single image intensifier tube 490 is employed, and it receives on its face 492 X rays emanating from X-ray tube 10 as shown. The output of image intensifier tube 490 appears on its output face 492 and is viewed by a single TV camera 493. In order to obtain a series of images for combination, or recombination, the system is controlled by a common sync generator 494 which triggers a circular beam signal generator, or beam control, 482, which, for example, then provides to deflection coils 90 of tube 10 a signal which provides it circular beam pattern shown.

With reference to FIG. 11, the microfocus tubehead electron beam dwells at each focal spot location for one or more video frames which in the U.S. normally occur at the rate of 30/sec (which includes the retrace time). The beam is advanced to the next focal spot location during retrace. Therefore, if it is time for one complete circular scan is $$\frac{N}{30},$$

where N is the number of focal spots around the circle (for eight, the time would be 8/30=4/15 sec). If it is desired to dwell for more than one frame, as might be the case where the signal-to-noise ratio is poor and frame integration is required, the time for a circular scan $$T_S = \frac{N \cdot F}{R},$$

where N=number of points around scan circle, F=number of frames at each point, and R=frame rate. For eight points, 2 frame/point and 30 frames/sec:

$$T_S = \frac{8 \cdot 2}{30} = \frac{16}{30} = \frac{8}{15} \text{ sec.}$$

The frequency of the sync pulse would be multiplied by eight by sweep multiplier 496 and fed to video digitizer 498. Video digitizer 498 then samples the pictorial image on image intensifier tube 490 for a brief instant each 45° of movement of beam 24 or eight times per revolution of beam 24. Video digitizer 498 then provides as an output eight digitized image sets, and these are supplied to memories 1-8 (501) wherein each of the eight images are discretely stored by one of the memories. Thereafter, they are separately fed to a computer, labeled tomosynthesis computer 500, which is programmed with a known tomosynthesis algorithm which effects a combination of the eight images and provides a resultant image to monitor 502.

Tomosynthesis technology has been further described in a paper entitled "Computer Tomosynthesis: A Versatile Three-Dimensional Imaging Technique" Ueruttimann, Rajgroenhuis and R. L. Webber, to be published. They have published other works on the subject. Actually, the basic principle of tomosynthesis emulated by Ziedes Des Plantes in 1935, who determined that the internal structure of an object may be represented in frontal cross sections by summations of a set of component radiographs, each imaging object at different projection angles. In a summa each imaging object at different projection angles. In a summation process, the radiographs are translated properly such that there is complete coincidence of the image corresponding to object points in the tomographic plane. The projection of the points outside the plane will not coincide exactly in the superimposition of the components to the same effect as described above with respect to the system shown in FIG. 10, and thus a blurring of detail will be effected. The end result is that tomosynthetic reconstruction produces a sharp image of structures in the desired plane, upon which blurred images of object details lying outside of the plane of interest are superimposed. The applicant's system enables this to be accomplished in real time and with a single X-ray tube, particularly because of its microfocus and scanning abilities.

It is significant that the target diameter of the X-ray tubehead of this invention may be fairly small, for example, on the order of ⅜" in diameter, and yet excellent results can be obtained. This follows, of course, from the geometry of the system shown. On the other hand, if the diameter does appear to be a limiting factor, it is, of course, possible to use larger size targets or perhaps two X-ray targets.

For conventional stereoimaging, the required focal spot separation $D_S$ is equal to about 10% of the FFD (focal spot to image plane distance). In projection magnification stereoimaging, the required focal spot separation is reduced by the magnification factor:

$$D_S = \frac{0.1 \times FFD}{M}$$

where $$M = \frac{a+b}{a}$$

and a=focal spot to object distance b=object to image plane distance.

For example: using a 10" FFD with the object 1" from the focal spot (a=1) and 9" from the image plane (b=9)

$$D_S = \frac{0.1 \times 10}{\frac{1+9}{1}} = \frac{1}{10} = 0.1''$$

Since tomosynthesis does not depend on the eye-brain perception of a stereoimage, no magical "stereo factor" numbers are involved. In general, the larger the circle diameter, the sharper each layer will appear (with a zero diameter, no layer image is obtained at all). Also, as the film focal distance FFD changes, the circle diameter would change proportionally to produce a uniform layer effect. These factors are all accommodated by the reconstruction algorithm.

As a practical example, the applicant has successfully used the following numbers for a tomosynthesis set-up with good results:

$$M\left(\text{magnification } \frac{a+b}{a};\ \begin{matrix} a = 2 \text{ cm} \\ b = 8 \text{ cm} \end{matrix}\right) = 5$$

FFD (focal spot to image plane distance)=10 cm

D (scan circle diameter)=½ cm

P (number of points on circle)=8.

Strangely, the number of points did not seem too critical; a good tomo image was produced with as few as four points.

As a general rule, it appears that the circle diameter $D_C$ should be 5% to 10% of the FFD reduced by the magnification:

$$D_C \approx \frac{.1 \times FFD}{M}$$

If sharper layer definition is required, the circle diameter is increased. If less sharp layers are required, it may be reduced.

Further significant in achieving excellent results is that by virtue of the configuration of the applicant's tubehead, it is possible to produce a near point source (on the order of 10 microns) focal spot at X-ray energy and intensity levels sufficient for real time imaging, as shown. By virtue of this essentially point size source, significant geometric image enlargement is achieved without significant loss of image inherent sharpness. This follows inasmuch as geometric magnification reduces the focal spot separation required for stereofluoroscopy by a factor of 1 divided by the geometric magnification, in turn equal to spot size to subject distance plus subject to plane image distance divided by focal spot to subject distance. This in turn enables stereofluoroscopy with relatively small focal spot separation as provided by sweeping an electron beam across an X-ray target, as described. Further, geometric magnification as practiced by the present invention improves image resolution for both stereofluoroscopic and tomofluoroscopic images by a factor approximately equal to the geometric magnification. This is due to the fact that the limiting resolution of the image receptor is much less significant if the X-ray image is first geometrically enlarged for image plane impingement as enabled by the present invention.

In addition to the application described above, other applications are made possible through the ability of the present inventon to rapidly switch the X-ray spot over multiple locations, these including stop motion real time X-ray images. In this latter application, an X-ray beam would be swept in unison with a test object motion to "freeze" the X-ray image. In frequency, amplitude and scan path of the X-ray focal spot is adjusted to coincide with a test object's motion under real time observation to stop any motion while at the same time providing an X-ray view.

I claim:

1. A microfocus X-ray system comprising:

a generally elongated vacuum enclosure;

electron beam generation means positioned within said enclosure for generating an electron beam;

a grid spaced from said electron beam generation means, said grid having an aperture through which an electron beam emitted by said electron beam generation means passes in a line generally along the longitudinal dimension of said enclosure;

acceleration means, including an anode and biasing means for positively biasing said anode with respect to said electron beam generation means, for accelerating electrons of said electron beam;

focusing means for acting on said electron beam as accelerated by said acceleration means and focusing said electron beam into a narrow beam on the order of 1 to 100 microns in width;

a metal target positioned to receive said electron beam and discharge X rays toward an object to be exposed outside of said enclosure;

horizontal beam deflection means responsive to a first square wave electrical signal for precipitously changing the horizontal path of the focused said electron beam such that it precipitously changes the point of impact on said target and therefrom produces X-ray radiation from essentially only two separated points of said target;

vertical beam deflection means responsive to a second square wave electrical signal for changing the vertical path of the focused said electron beam such that it changes the area of impact on said target of said electron beam;

signal means for continuously and sequentially generating said first square wave electrical signal and coupling it to said horizontal deflection means second signal means for continuously and sequentially generating said second square wave electrical signal and coupling it to said vertical deflection means; and display means, including X ray-to-visible light conversion means positioned to receive images of said X-ray beams transiting a said object, for sequentially and in real time displaying images only in terms of X rays emanating from said two separated points on said target.

2. A microfocus X-ray system as set forth in claim 1 wherein said display means includes at least one visible image display, a TV camera positioned to view said visual image display, at least one TV monitor coupled to the output of said TV camera, and synchronization means coupled to said signal means, said display means, said TV camera, and said TV monitor for synchronizing the occurrence of each said positioned X-ray beam with a reproduction of the image of said object produced by that beam.

3. A microfocus X-ray system as set forth in claim 1 including viewing means for enabling a viewer to observe one image with one eye derived from said one positioned X-ray beam and enabling the observation of a second image with the other eye of the viewer derived from a second positioned X-ray beam.

4. A microfocus X-ray system as set forth in claim 2 wherein said display means includes a single said TV monitor, and said viewing means includes a first shutter means responsive to said signal means for alternately blocking and unblocking the view of said single TV monitor from one eye of the viewer and second shutter means responsive to said signal means for alternately blocking and unblocking the view of said TV monitor from a second eye of a viewer, such that one perspective view of said object is seen by one eye as a function of the position of said one X-ray beam, and a second perspective view is seen by the other eye of a viewer as a function of the second positioned X-ray beam.

5. A microfocus X-ray system as set forth in claim 2 wherein said display means includes first and second TV monitors coupled to said TV camera, and said viewing means includes means for enabling only a first eye of a viewer to view said first TV monitor and only a second eye of a viewer to view said second TV monitor, and said synchronization means includes means for alternating enabling reproduction by said first and second TV monitors in synchronization with the alternate occurrences of said one said positioned X-ray beam and said second positioned X-ray beam.

6. A microfocus X-ray system as set forth in claim 2 wherein said display means includes:

a video digitizer coupled to the output of said TV camera;

first and second digital memories coupled to the output of said video digitizer;

said video digitizer being coupled to said signal means such that coordinate with a said first value of said electrical signal, said video digitizer provides to said first digital memory a digitally encoded field representative of a first perspective view of a said object during the presence of first positioned X-ray beam, and, coordinate with a second value of said electrical signal, said video digitizer provides to said second digital memory a digitally encoded field representative of a second positioned X-ray beam; and pictorial computing means alternately responsive to said first and second memories for perspectively combining the fields stored in said first and second memories and providing the same to said TV monitor.

7. A microfocus X-ray system as set forth in claim 2 wherein:

said image display means includes first and second spaced image visible light displays, and each having an image responsive X-ray input, and said input of said visible light display being spaced wherein a selected image area of an object is projected by X-ray radiation from one said separated point of said target onto a selected central position of a said input of said first visible light display, and said selected image area of said object is projected by X-ray radiation from another said separated point of said target onto a like selected central position of the input of said second visible light image display, such that X-ray beams from image areas of said object other than said selected image area of said object are projected onto non-like positioned areas of said inputs of said visible light displays, such that visible light outputs of said first and second visible light displays produce non-like reproduction of other than said selected image area of said object; and combining means for adding and displaying in register, the outputs of said visible light display means, such that the detail of said selected image area is enhanced and all other of view rendered indistinct.

8. A microfocus X-ray system as set forth in claim 7 wherein said combining means includes:

a first TV camera coupled to view the output of said first visible light display, and a second TV camera coupled to view the output of said second visible light display;

image combination means coupled to the outputs of said first and second TV cameras including means for summing the discrete pixels of views of the outputs of said first and second cameras for providing as an output a compositive TV image, wherein said selected image area is enhanced and other areas of said object appear indistinct; and a television monitor coupled to the output of said image combination means.

9. A microfocus X-ray system comprising:

an elongated vacuum enclosure having first and second detachable chambers;

electron beam generation means positioned in said first chamber and comprising a filament-cathode and a grid spaced from said filament-cathode, said grid having an aperture through which an electron beam emitted by said filament-cathode passes in a line which is generally along the longitudinal dimension of said enclosure, said beam passing from said first chamber into said second chamber;

said second chamber being tubular and extending around said electron beam;

a focusing coil wound around said beam and adjacent to said tubular second chamber;

an anode having an opening therethrough for passage of said electron beam, said anode being positioned immediately between said grid and said focusing coil;

a metal target positioned at an extreme end of said second chamber which is downstream in terms of the passage of said beam, and said target being electrically connected to said anode;

beam deflection means positioned proximate to said electron beam and, responsive to electrical signals, for selectively positioning said electron beam onto selected areas of a target;

a window of X-ray permeable material positioned adjacent to said target through which emitted X-rays, responsive to bombardment of said target by said electron beam, pass from said second chamber;

first biasing means for applying a heater voltage to said filament-cathode, second biasing means for adjustably applying a negative voltage to said grid with respect to said filament-cathode, and third biasing means for adjustably applying an accelerating voltage to said anode, said accelerated voltage being connected as a negative potential on said filament-cathode with respect to said anode;

power control means responsive to electron beam current passing in circuit between said filament-cathode and target for controllably adjusting the voltage of said second biasing means for effecting a grid bias of a value for maintaining a selected value of electron beam power; and focusing control means coupled to said focusing coil and responsive to the voltage of said third biasing means for applying an electrical input to said focusing coil of a level which varies as a function of anode-to-cathode voltage for maintaining an electron spot size within the range of 10 to 100 microns.

10. A microfocus X-ray system as set forth in claim 9 wherein:

said signal means includes means for generating electrical signals representative of a circular deflection path of said electron beam and thereby a circular path of origin of said X-ray beam;

a plurality of digital memories including means for storing in each memory a digitally encoded image;

a video digitizer coupled to the output of said TV camera and said signal means and including means for providing to each of said digital memories a digitally encoded image representative of an image derived from a discrete X-ray beam position; and computing means, responsive to said digital memories and the digital representation of discrete images stored in said digital memories, for combining said images electrically and providing the same to said TV monitor, whereby tomographic representation of a plane in an object subject to multiple positioned X-ray beams is providable as an output to said TV monitor.

11. An X-ray system as set forth in claim 9 wherein:

said filament includes first and second filament conductive prongs, and said first and second mating electrical conductors include first and second conductive receptacles for receiving said first and second conductive prongs; and said grid has a threaded periphery outboard of said aperture, and said third mating electrical conductor includes a mating threaded receptacle for receiving said grid.

12. An X-ray system as set forth in claim 10 wherein:

said system includes an X-ray imaging means responsive to said X rays for providing a real time visual presentation of X-ray patterns;

said system includes a mateable electrical plug attached to and positioned within said first chamber and having first, second, and third mateable conductive members;

said first biasing means includes means for connection, from outside to inside of said first vacuum chamber and to said first and second mateable conductive members, such that a filament bias is applied to said first and second conductive members;

said biasing means include means for connection, from outside to inside of said first vacuum chamber, to said third mateable conductive member of said negative voltage; and said electron beam generation means includes first and second mating electrical conductors connected to said filament-cathode and configured to interplug with said first and second mateable conductive members, and a third mating electrical conductor connected to said grid and configured to interplug with said third mateable conductive member, such that said electron beam generation means may be plugged and unplugged from within said first chamber.

13. A microfocus X-ray system comprising:

an elongated vacuum enclosure;

electron beam generation means positioned in said enclosure and comprising a filament-cathode and a grid spaced from said filament-cathode, said grid having an aperture through which an electron beam emitted by said filament-cathode passes in a line which is generally along the longitudinal dimension of said enclosure;

a focusing coil positioned around said beam;

an anode having an opening therethrough for passage of said electron beam, said anode being positioned immediately between said grid and said focusing coil;

a metal target positioned at an extreme end of said enclosure which is downstream in terms of the passage of said beam and positioned to receive said electron beam and discharge X rays toward an object to be exposed outside of said enclosure, and said target being electrically connected to said anode;

beam deflection means positioned proximate to said electron beam and, responsive to electrical signals, for selectively positioning said electron beam onto different areas of said target, such that X rays emanate from different areas of said target;

first biasing means for applying a heater voltage to said filament-cathode, second biasing means for adjustably applying a negative voltage to said grid with respect to said filament-cathode, and third biasing means for adjustably applying an accelerating voltage to said anode, said accelerating voltage being connected as a negative potential on said filament-cathode with respect to said anode;

power control means responsive to electron beam current for controllably adjusting the voltage of said second biasing means for effecting a grid bias of a value for maintaining a selected value of electron beam power; and focusing control means coupled to said focusing coil and responsive to the voltage of said third biasing means for applying an electrical input to said focusing coil of a level which varies as a function of anode-to-filament-cathode voltage for maintaining an electron spot size within the range of 10 to 100 microns.

14. A system as set forth in claim 13 wherein said power control means is further responsive to the voltage of said third biasing means.

15. A system as et forth in claim 14 wherein said enclosure comprises first and second openably attached chambers, said filament-cathode being in said first chamber, and said target being in said second chamber, and said system includes pressure sensing means for providing an electrical output representative of the pressure within said enclosure, and pumping means responsive to said electrical output for maintaining a vacuum pressure in said enclosure between $10^{-4}$ to $10^{-6}$ Torr.

16. A microfocus X-ray system comprising:

an elongated vacuum enclosure having first and second vacuum chambers;

electron beam generation means including a cathode positioned within said first chamber for generating an electron beam having a beam powered upward to approximately 800 watts and including a filament-cathode and a grid spaced from said filament-cathode, said grid having an aperture through which an electron beam emitted by said filament-cathode passes in a line which is generally along the longitudinal dimension of said enclosure, said beam passing from said first chamber into said second chamber;

focusing means including a focusing coil for focusing said electron beam into a narrow beam;

acceleration means including an anode having an opening therethrough for passage of said electron beam, said anode being positioned intermediately between said grid and said focusing coil;

first biasing means for applying a heater voltage to said filament-cathode, second biasing means for adjustably applying a negative voltage to said grid with respect to said filament-cathode, and third biasing means for adjustably applying an accelerating voltage to said anode, said accelerating voltage being connected as a ground potential to said anode and as a negative potential on said filament-cathode;

focusing control means coupled to said focusing coil and responsive to the voltage of said third biasing means for applying an electrical input to said focusing coil of a level which varies as a function of anode-to-filament-cathode voltage for maintaining a selected electron beam size;

an X-ray emitting target positioned at an extreme end of said second chamber which is downstream in terms of the passage of said beam, said target being electrically connected to said anode;

power control means responsive to both the voltage of said third biasing means and electron beam current passing in circuit between said filament-cathode and target for controllably adjusting the voltage of said second biasing means for effecting a grid bias of a value for maintaining a selected value of electron beam power;

horizontal beam deflection means responsive to a first square wave electrical signal for precipitously changing the horizontal path of the focused said electron beam such that it precipitously changes the point of impact on said target and therefrom produces X-ray radiation from essentially only two separated points of said target;

vertical beam deflection means responsive to a second square wave electrical signal for changing the vertical path of the focused said electron beam such that it changes the area of impact on said target of said electron beam;

first signal means for continuously and sequentially generating said first square wave electrical signal and coupling it to said horizontal deflection means;

second signal means for continuously and sequentially generating said second square wave electrical signal and coupling it to said vertical deflection means; and display means, including X ray-to-visible light conversion means positioned to receive images of said X-ray beams irradiating an object, for sequentially and in real time displaying discrete images only in terms of different and separated X-ray beams, and said display means includes at least one visible light display, a TV camera positioned to view said visual image display, at least one TV monitor coupled to the output of said TV camera, and synchronization means coupled to said signal means, said display means, said TV camera, and said TV monitor for synchronizing the occurrence of each separated X-ray beam with a reproduction of the image of an object produced by that beam.

* * * * *